United States Patent [19]

Kato et al.

[11] Patent Number: 4,958,612

[45] Date of Patent: Sep. 25, 1990

[54] AIR-FUEL RATIO CONTROL METHOD FOR INTERNAL COMBUSTION ENGINES

[75] Inventors: Akira Kato; Toru Yano, both of Wako, Japan

[73] Assignee: Honda Giken Kogyo K.K., Tokyo, Japan

[21] Appl. No.: 368,377

[22] Filed: Jun. 19, 1989

[30] Foreign Application Priority Data

Jun. 30, 1988 [JP] Japan ..... 63-162858

[51] Int. Cl.[5] ..... F02D 41/14

[52] U.S. Cl. ..... 123/489; 123/493

[58] Field of Search ..... 123/325, 326, 440, 489, 123/493

[56] References Cited

U.S. PATENT DOCUMENTS 4,174,682 11/1979 Drews et al. ..... 123/489 X
4,697,559 10/1987 Suzuki et al. ..... 123/489 X
4,697,567 10/1987 Sawada et al. ..... 123/493 X

FOREIGN PATENT DOCUMENTS 6052 2/1983 Japan .

*Primary Examiner*—Tony M. Argenbright
*Attorney, Agent, or Firm*—Arthur L. Lessler

[57] ABSTRACT

An air-fuel ratio control method for an internal combustion engine having an exhaust gas-ingredient concentration sensor provided in an exhaust system and generating an output proportional to the concentration of an ingredient in exhaust gases emitted from the engine. The air-fuel ratio of a mixture supplied to the engine is controlled to a desired air-fuel ratio corresponding to an operating condition in which the engine is operating, in a feedback manner responsive to the output of the sensor. Supply of fuel to the engine is interrupted while the engine is in a predetermined decelerating condition. The method comprises the steps of progressively decreasing the desired air-fuel ratio from a value larger than a value corresponding to the operating condition of the engine to the latter value after the engine leaves the predetermined decelerating condition, and controlling the air-fuel ratio of the mixture supplied to the engine to the progressively decreased air-fuel ratio in the feedback manner.

11 Claims, 8 Drawing Sheets

| FIG. 3A |
| --- |
| FIG. 3B |

| |
|---|
| FIG. 4A |
| FIG. 4B |

FIG. 5
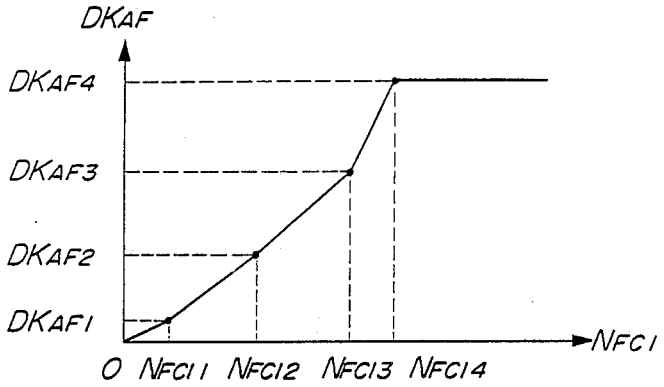
FIG. 6A
FIG. 6B
FIG. 6C
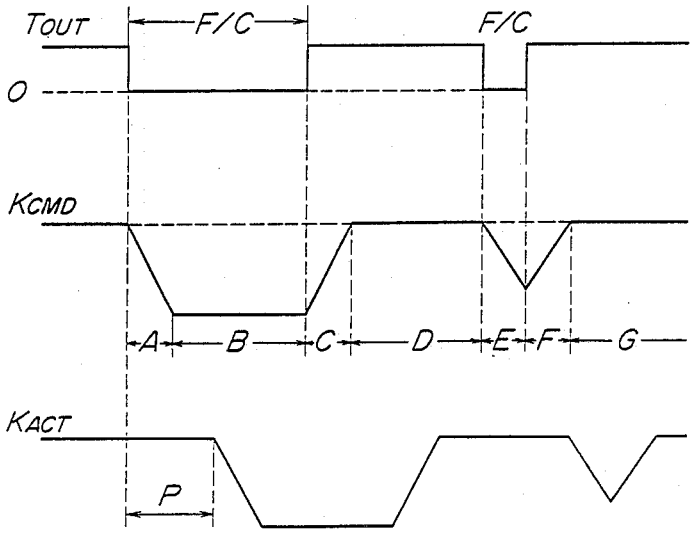

AIR-FUEL RATIO CONTROL METHOD FOR INTERNAL COMBUSTION ENGINES

BACKGROUND OF THE INVENTION

The present invention relates to an air-fuel ratio control method for internal combustion engines, and more particularly to a method of properly controlling the air-fuel ratio of a mixture of fuel supplied to the engine after interruption of fuel supply which is effected when the engine is in a predetermined decelerating condition.

Conventionally, it is well known to control the air-fuel ratio of a mixture supplied to an internal combustion engine (hereinafter referred to as "the actual air-fuel ratio") by sensing the concentration of an ingredient of exhaust gases emitted from the engine by means of an exhaust-gas concentration sensor provided in the exhaust system of the engine, and effecting feedback control in response to the sensed ingredient concentration to bring the air-fuel ratio to a desired set value, to thereby improve the fuel consumption and emission characteristics, etc., of the engine.

It is also known to interrupt supply of fuel to an internal combustion engine when the engine is in a predetermined decelerating condition (hereinafter referred to as "fuel cut"), in order to improve the fuel consumption, etc. of the engine.

However, the feedback control of the air-fuel ratio had a difficulty when it is carried out to restart the fuel supply following the fuel cut.

Specifically, when the fuel cut is being carried out, the actual air-fuel ratio is extremely lean. When the fuel cut is terminated, the feedback control is resumed to control the air-fuel ratio in response to the extremely lean actual air-fuel ratio. Consequently, the actual air-fuel ratio becomes temporarily overrich due to control delay.

To solve the above problem, an air-fuel ratio control method has been proposed, e.g., by Japanese Patent Publication (Kokoku) No. 58-6052, which restarts the feedback control when a predetermined time period has elapsed after resumption of fuel supply to the engine following fuel cut, thereby coping with the control delay.

However, the proposed method has the disadvantage that the actual air-fuel ratio cannot be properly controlled to a desired set value immediately after termination of the fuel cut, which may lead to increased fuel consumption and degraded emission characteristics.

Specifically, when fuel cut is carried out, almost all the fuel adhering to the inner wall of the intake pipe is supplied to the engine cylinders. Accordingly, immediately after termination of the fuel cut, a considerable part of the fuel injected adheres to the intake pipe inner wall so that the actual air-fuel ratio is temporarily leaned. Thereafter, the actual air-fuel ratio enters a transient state wherein it gradually becomes closer to a desired air-fuel ratio with an increase in the amount of fuel adhering to the intake pipe inner wall, and then the actual air-fuel ratio shifts into a steady state wherein the amount of the adhering fuel no longer increases.

On the other hand, the proposed method uses an exhaust gas-ingredient concentration sensor of the type having an output invertible in response to a change in the actual air-fuel ratio across a desired air-fuel ratio having a fixed value, e.g., a stoichiometric ratio.

Therefore, even if the above predetermined time period is set to a relatively short value to advance the commencement timing of the feedback control, i.e., if the feedback control is commenced when the actual air-fuel ratio is still in the transient state, there exists a large difference in value between the actual air-fuel ratio which is still lean and the fixed desired air-fuel ratio so that the air-fuel ratio is largely controlled to compensate for the difference or enrich the mixture. As a result, the actual air-fuel ratio becomes overrich when it reaches the steady state, spoiling the controllability of the air-fuel ratio.

Conversely, to eliminate this disadvantage, if the predetermined time period is set to a relatively long value to retard the commencement timing of the feedback control, the feedback control is not carried out during the transient state, thereby lowering the accuracy of the air-fuel ratio control.

SUMMARY OF THE INVENTION

It is therefore the object of the invention to provide an air-fuel ratio control method for internal combustion engines, which is capable of properly controlling the air-fuel ratio immediately after fuel supply is resumed after fuel cut, thereby improving the stability and accuracy of control and hence improving the fuel consumption and emission characteristics, etc.

To achieve the above object, the present invention provides an air-fuel ratio control method for an internal combustion engine having an exhaust gas-ingredient concentration sensor provided in an exhaust system thereof and generating an output proportional to the concentration of an ingredient contained in exhaust gases emitted from the engine, wherein the air-fuel ratio of a mixture supplied to the engine is controlled to a desired air-fuel ratio corresponding to an operating condition in which the engine is operating, in a feedback manner responsive to the output of the sensor, and supply of fuel to the engine is interrupted while the engine is in a predetermined decelerating condition.

The present invention is characterised by a improvement comprising the steps of:

progressively decreasing the desired air-fuel ratio from a value larger than a value corresponding to the operating condition of the engine to the latter value after the engine leaves the predetermined decelerating condition, and controlling the air-fuel ratio of the mixture supplied to the engine to the progressively decreased air-fuel ratio in the feedback manner.

Preferably, the progressive decrease of the desired air-fuel ratio may be effected based upon a time period over which the interruption of fuel supply was effected and a time period elapsed after termination of the interruption of fuel supply.

More preferably, the method may comprise the steps of determining a provisional value of the desired air-fuel ratio depending upon operating conditions of the engine after the engine leaves the predetermined decelerating condition, determining a first value based upon the time period over which the interruption of fuel supply to the engine was effected, determining a second value based upon the time period elapsed after termination of the interruption of fuel supply, and correcting the provisional value of the desired air-fuel ratio by the determined first and second values to progressively decrease the desired air-fuel ratio.

The method may comprise the steps of determining a provisional value of a coefficient determining the desired air-fuel ratio depending upon operating conditions of the engine after the engine leaves the predetermined decelerating condition, determining a first value based upon the time period over which the interruption of fuel supply to the engine was effected, determining a second value based upon the time period after termination of the interruption of fuel supply, correcting the determined provisional value of the coefficient by the determined first and second values, and correcting a basic fuel supply amount corresponding to operating conditions of the engine by the corrected value of the coefficient to progressively decrease the desired air-fuel ratio.

The first value may be subtracted from the second value to obtain a difference therebetween, and the determined provisional value of the coefficient is corrected by the difference.

The method may include the steps of determining a value of a second coefficient in response to the output of the sensor, and correcting the basic fuel supply amount based upon a difference between the corrected value of the first coefficient determining the desired air-fuel ratio and the determined value of the second coefficient.

The basic fuel supply amount may be corrected based upon a difference between the corrected value of the first coefficient determined upon generation of a pulse of a crank angle signal generated at a predetermined crank angle of the engine before generation of the present pulse by a predetermined number of pulses and the value of the second coefficient determined upon generation of the present pulse of the second coefficient.

The above and other objects, features, and advantages of the invention will be more apparent from the ensuing detailed description taken in conjunction with the accompanying drawings.

BRIEF DESCRIPTION OF THE DRAWINGS

FIG. 5 is a graph showing a table of a decremental value $DK_{AF}$ applied in the subroutine of FIG. 4;

FIG. 6 is a timing chart showing, by way of an example, changes in the desired air-fuel ratio coefficient $K_{CMD}$ and an actual air-fuel ratio coefficient $K_{ACT}$, responsive to execution and termination of fuel cut;

DETAILED DESCRIPTION

The invention will now be described in detail with reference to the drawings, showing an embodiment thereof.

Figure 1:
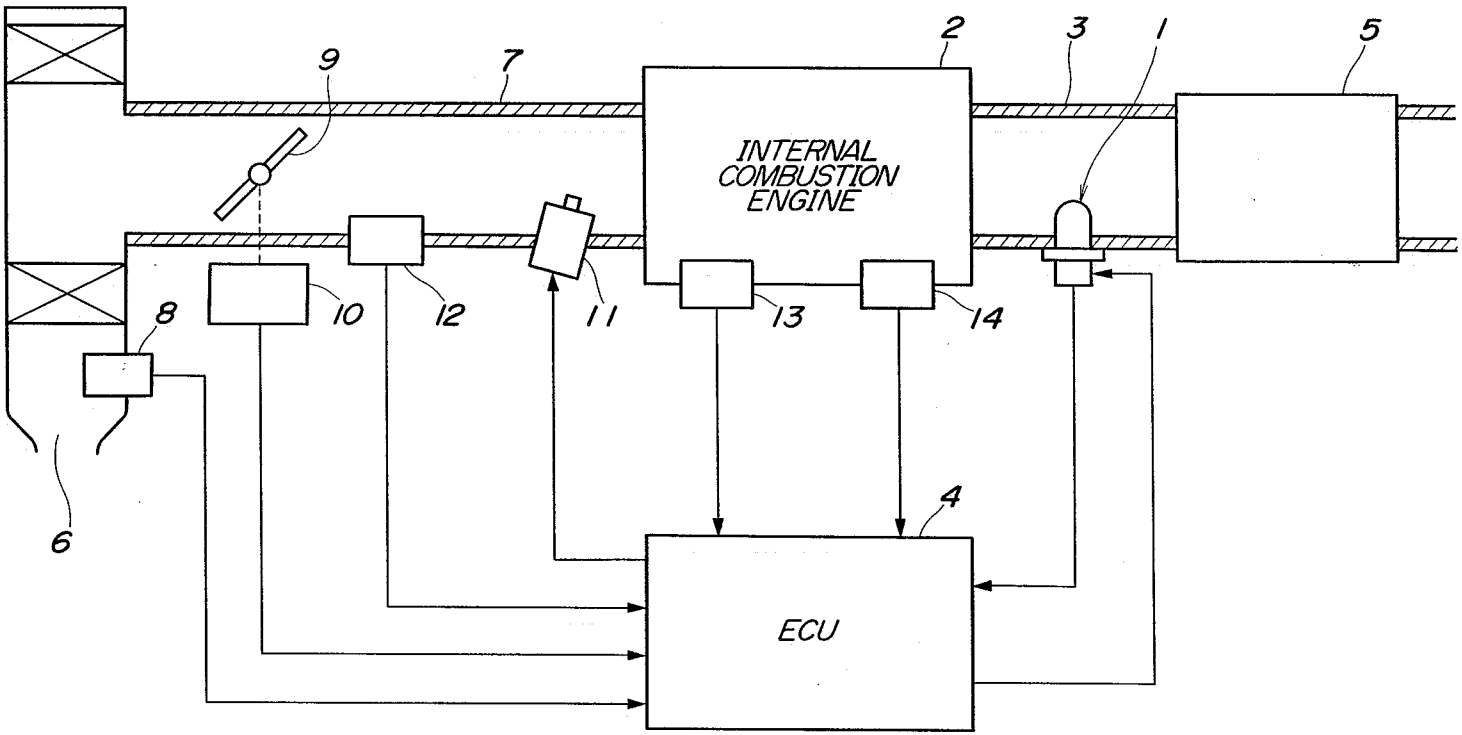
FIG. 1 is a block diagram of the overall arrangement of a fuel supply control system of an internal combustion engine, to which is applied the method according to the invention.

Referring first to FIG. 1, there is illustrated the overall arrangement of a fuel supply control system for an internal combustion engine, to which is applied the method according to the invention. In the figure, reference numeral 1 designates an oxygen concentration sensor (hereinafter referred to as "the $O_2$ sensor") as an exhaust gas concentration sensor, which is inserted in an exhaust pipe 3 extending from the cylinder block of the engine 2. In the illustrated embodiment, the $O_2$ sensor 1 is of the proportional-output type, as described in detail later, and senses the concentration of oxygen in exhaust gases emitted from the engine 2 to supply an electrical signal indicative of the sensed oxygen concentration to an electronic control unit (hereinafter referred to as "the ECU") 4.

A three-way catalyst 5 is arranged in the exhaust pipe 3 at a location downstream of the $O_2$ sensor 1 for purifying ingredients HC, CO, and NOx contained in the exhaust gases.

The engine 2 may be a four-cylinder four-cycle type, for example, to which intake air is supplied through an air cleaner 6 and an intake pipe 7. An intake air temperature ($T_A$) sensor 8 is provided in the air cleaner 6 for sensing the temperature $T_A$ of intake air and supplying an electrical signal indicative of the sensed intake temperature to the ECU 4. Arranged in the intake pipe 7 is a throttle valve 9, to which is connected a throttle valve opening ($\theta_{TH}$) sensor 10 to supply an electrical signal indicative of the sensed opening $\theta_{TH}$ of the throttle valve 9 to the ECU 4.

Fuel injection valves 11, only one of which is shown, are arranged in the intake pipe 7 at a location downstream of the throttle valve 9 and slightly upstream of respective corresponding intake valves, not shown, to supply fuel to respective corresponding cylinders of the engine 2. Each fuel injection valve 11 is connected to a fuel pump, not shown, to be supplied with pressurized fuel therefrom, and electrically connected to the ECU 4 to have its valve opening period controlled by a driving signal therefrom.

An absolute pressure ($P_{BA}$) sensor 12 is arranged in the intake pipe 7 at a location immediately downstream of the throttle valve 9 to detect absolute pressure $P_{BA}$ within the intake pipe 7. The $P_{BA}$ sensor 12 gives an electrical signal indicative of the detected absolute pressure $P_{BA}$ to the ECU 4.

An engine coolant temperature ($T_W$) sensor 13, which may be formed of a thermistor or the like, is mounted in the cylinder block of the engine 2, detects engine coolant temperature $T_W$, and supplies an electrical signal indicative of the detected engine coolant temperature to the ECU 4. An engine rotational speed (Ne) sensor 14 is arranged in facing relation to a camshaft, not shown, of the engine 2 or a crankshft of same, not shown. The Ne sensor 14 is adapted to generate a pulse of a top-dead-center position (TDC) signal at one of predetermined crank angles of the engine 2, whenever the engine crankshaft rotates through 180 degrees. Pulses generated by the Ne sensor 14 are supplied to the ECU 4.

Figure 2:
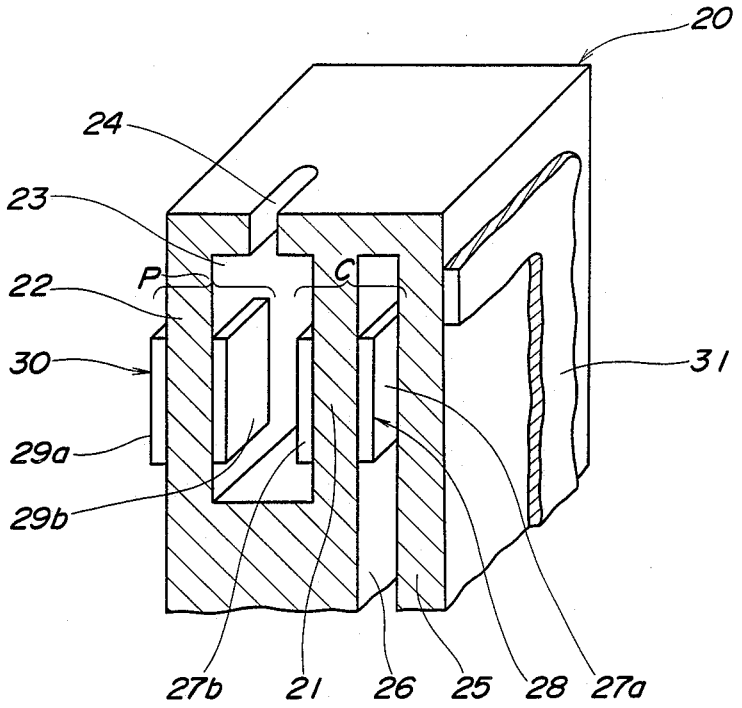
FIG. 2 is a perspective cross-sectional view of essential parts of an oxygen concentration sensor ($O_2$ sensor) in FIG. 1.

FIG. 2 shows the construction of the $O_2$ sensor 1. The $O_2$ sensor 1 has a body 20 formed in a generally shape and of a solid electrolytic material having oxygen ion-conductivity, such as zirconium dioxide ($ZrO_2$). The body 20 has a first wall 21 forming part of a cell element 28 and a second wall 22 forming part of an oxygen-pumping element 30, which extend parallel to each other. A gas diffusion chamber 23 is defined within the body 20 between the first and second walls 21 and 22, which communicates with the interior of the exhaust pipe 3 through a gas-introducing slit 24 formed in the upper wall of the body 20 for introducing exhaust gases thereinto. The body 20 also has an outer wall 25 defining an air reference chamber 26 in cooperation with the first wall 21 to be supplied with air.

The first wall 21 carries on its opposite sides a couple of electrodes 27*a* and 27*b* formed of platinium (Pt) and forming part of the cell element 28, whereas the second wall 22 carries on its opposite sides a couple of electrodes 29*a* and 29*b* also formed of platinum and forming part of the oxygen-pumping element 30. A heater 31 is provided on the outer surface of the outer wall 25 for heating the body 20, i.e., the cell element 28 and the oxygen-pumping element 30, for promoting the activation of the elements.

Figures 3, 3A:
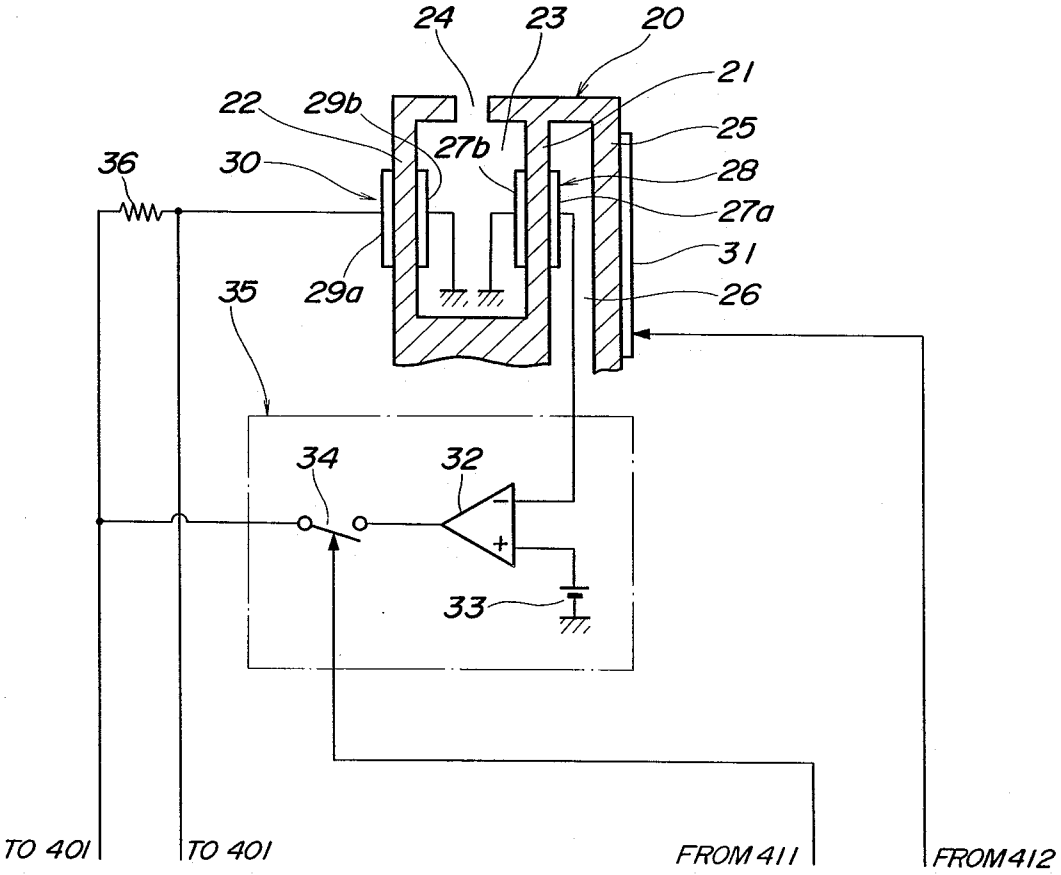
FIGS. 3, 3A and 3B are a block diagram of an air-fuel ratio control system including the oxygen concentration sensor.
Figure 3B:
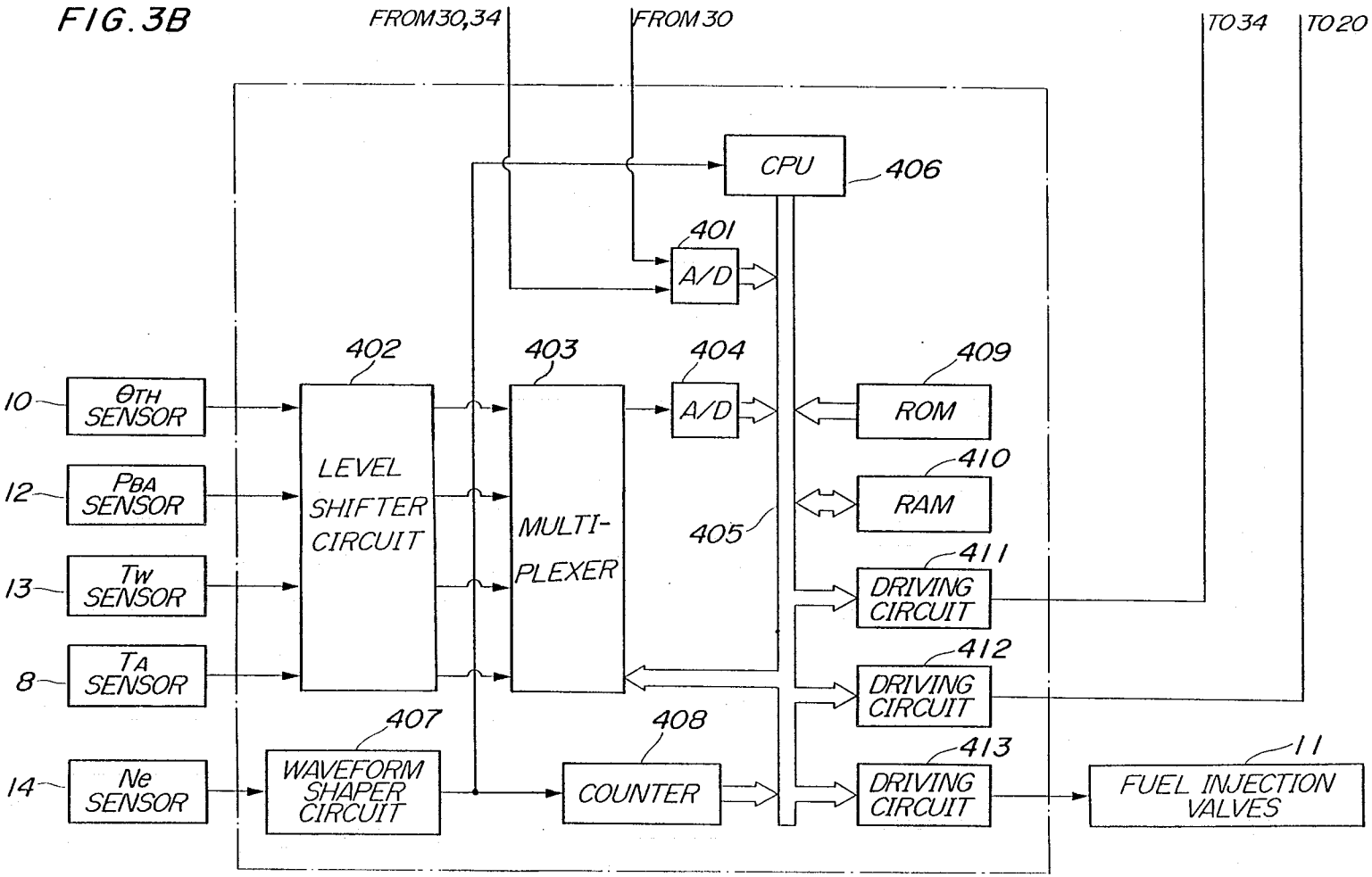

FIG. 3 shows a block diagram of the air-fuel ratio control system incorporating the 02 sensor 1, according to the invention. Respective electrodes 27*b* and 29*b* of the cell element 28 and the oxygen-pumping element 30 on the gas diffusion chamber 23 side are grounded An electrode 27*a* of the cell element 28 on the air reference chamber 26 side is connected to an inverting input terminal of a differential amplifier 32. The differential amplifier 32 forms a current-supply circuit 35 for supplying electric current to the $O_2$ sensor 1 in cooperation with a reference voltage source 33 connected to a non-inverting input terminal thereof, and a switch 34 connected to an output of the amplifier 32. A reference voltage $V_{so}$ from the reference voltage source 33 is set at such a value, 0.4 volts, for example, which is equal to a voltage to be developed across the cell element 28 when the air-fuel ratio of a mixture supplied to the engine 2 is equal to the stoichiometric value.

The switch 34 has one end thereof connected to one end of a current-detecting resistance 36 which has the other end connected to the electrode 29*a* on the outer side of the oxygen-pumping element 30.

The current-supply circuit 35 and the current-detecting resistance 36 are both incorporated in the ECU 4 so that a terminal voltage across the resistance 36 is supplied as an output of the $O_2$ sensor 1 to an A/D converter 401 in the ECU 4.

The ECU 4 includes a level shifter circuit 404 which shifts output voltages from various sensors such as the intake air temperature ($T_A$) sensor 8, the throttle valve opening ($\theta_{TH}$) sensor 10, the intake pipe absolute pressure ($P_{BA}$) sensor 12, and the engine coolant temperature ($T_W$) sensor 13, to a predetermined level. The level-shifted output voltages are then successively supplied to an A/D converter 404 through a multiplexer 403. The A/D converters 401 and 406 convert the analog values of the level-shifted input signals to corresponding digital values, and supply them to a central processing unit (hereinafter referred to as "the CPU") 406 via a data bus 405.

On the other hand, an output signal from the engine rotational speed (Ne) sensor 14 has its waveform shaped by a waveform shaper 407, and the shaped signal is supplied to the CPU 406 as well as a counter 408. The counter 408 counts the time interval between an immediately preceding pulse of the TDC signal and a present pulse of same, the counted value Me thereof being proportional to the reciprocal of the engine rotational speed Ne. The counter 408 supplies the counted value Me to the CPU 406 via the data bus 405.

Further connected to the CPU 406 via the data bus 405 are a read-only memory (hereinafter referred to as "the ROM") 409, a random access memory (hereinafter referred to as "the RAM") 410, and driving circuits 411 to 413. The RAM 410 temporarily stores results of operations executed by the CPU 406, whereas the ROM 409 stores control programs to be executed by the CPU 406 and maps or the like for calculating the fuel injection period $T_{OUT}$ of the fuel injection valves 11.

The CUP 406 determines based on a control program, not shown, stored in the ROM 409 whether the switch 34 should be turned on or off and whether the heater 31 should be supplied with electrical current or not, and supplies respective driving signals depending upon the determinations to the switch 34 and the heater 31 through the driving circuits 411 and 412.

The CPU 406 determines operating conditions of the engine such as a feedback control region, based on the aforementioned various engine parameter signals including an output signal from the $O_2$ sensor 1, and calculates the fuel injection period of the fuel injection valves 11 in synchronism with TDC signal pulses in response to the determined engine operating conditions, based on a control program, not shown, by the use of the following equation (1):

$$T_{OUT}=Ti\times K_{02}\times K_1+K_2 \quad (1)$$

where Ti represents a basic fuel injection period, which is calculated from a Ti map, not shown, stored in the ROM 409, in response e.g. to the absolute pressure $P_{BA}$ within the engine intake pipe, and the engine rotational speed Ne. $K_{02}$ represents an air-fuel ratio correction coefficient, which is determined, in response to the difference in value between a desired air-fuel ratio coefficient $K_{CMD}$ and an actual air-fuel ratio coefficient $K_{ACT}$, based on a control program, not shown, and set to a predetermined value, when the engine is in an open-loop control region, i.e., in a region other than the feedback control region.

The desired air-fuel ratio coefficient (hereinafter referred to as "the desired ratio coefficient") $K_{CMD}$ is a coefficient corresponding to a desired air-fuel ratio, which is calculated based on a control program of FIG. 4, hereinafter described. The actual air-fuel ratio coefficient (hereinafter referred to as "the actual ratio coefficient") $K_{ACT}$ is a coefficient corresponding to an actual air-fuel ratio, which is calculated from an output value of the $O_2$ sensor 1 based on a control program, not shown. The desired or actual ratio coefficient $K_{CMD}$, $K_{ACT}$ is set based upon a control program, not shown, in response to the output from the $O_2$ sensor 1 such that it is set to 1.0 when the desired or actual air-fuel ratio is equal to the stoichiometric ratio, e.g., 14.7, to a larger value above 1.0 as the desired or actual air-fuel ratio becomes richer with respect to the stoichiometric ratio, and to a smaller value below 1.0 as the desired or actual air-fuel ratio becomes leaner with respect to the stoichiometric ratio.

$K_1$ and $K_2$ respectively represent other correction coefficients and correction variables which are calculated in response to various engine parameter signals to such desired values as to optimize operating characteristics of the engine such as fuel consumption and accelerability.

The operation of the air-fuel ratio control system constructed as above will now be described below.

Referring first to the operation of the $O_2$ sensor 1, when the engine 2 is operated, part of exhaust gases emitted into the exhaust pipe 3 are introduced into the gas diffusion chamber 23 through the first slit 24. This causes a difference in oxygen concentration between the gas diffusion chamber 23 and the air reference chamber 26 into which air is introduced. Consequently, a voltage Vs corresponding to the difference is developed between the electrodes 27a and 27b of the cell element 28 so long as the cell element 28 is activated, which is applied to the inverting input terminal of the differential amplifier circuit 32. As stated before, the reference voltage Vso supplied to the non-inverting input terminal of the differential amplifier circuit 32 is set at a value of the voltage Vs which is to be developed across the cell element 28 when the actual air-fuel ratio is equal to the stoichiometric ratio.

Therefore, when the air-fuel ratio is on the lean side with respect to the stoichiometric ratio, the voltage Vs between the electrodes 27a and 27b of the cell element 28 lowers below the reference voltage Vso so that the output level of the differential amplifier circuit 32 becomes positive, and the positive level voltage is applied to the oxygen-pumping element 30 via the switch 34 and the current-detecting resistance 36. When the oxygen-pumping element 30 is activated, the application of the positive level voltage causes ionization of oxygen present within the gas diffusion chamber 23, whereby the resulting ions move through the electrode 29b, the second wall 22, and the electrode 29a to be emitted therefrom or pumped out of the $O_2$ sensor 1. At the same time, pumping current Ip flows from the electrode 29a to the On the other hand, when the air-fuel ratio is on the rich side with respect to the stoichiometric ratio, the voltage Vs between the electrodes 27a and 27b of the cell element 28 becomes higher than the reference voltage Vso, so that the output level of the differential amplifier circuit 32 becomes negative. Consequently, reversely to the above described action, external oxygen is pumped into the gas diffusion chamber 23 through the oxygen-pumping element 30, and simultaneously the pumping current Ip flows from the electrode 29b to the electrode 29a, that is, the direction of flow of the pumping current Ip is reversed to the above case.

When the actual air-fuel ratio is equal to the stoichiometric air-fuel ratio, the voltage Vs between the electrodes 27a and 27b of the cell element 28 becomes equal to the reference voltage Vso, so that the pumping-in and -out of oxygen is not effected, whereby no pumping current flows (that is, the pumping current Ip is zero).

Since the pumping-in and -out of oxygen and hence the pumping current Ip are thus controlled so as to maintain the oxygen concentration within the gas diffusion chamber 23 at a constant level, the pumping current Ip assumes a value proportional to the oxygen concentration of the exhaust gases on each of the lean and rich sides of the actual air-fuel ratio with respect to the stoichiometric ratio.

The value of the pumping current Ip is detected in the form of a voltage drop across the current-detecting resistance 36 or voltage between the opposite ends of the resistance 36 and is supplied to the ECU 4.

Figures 4, 4A:
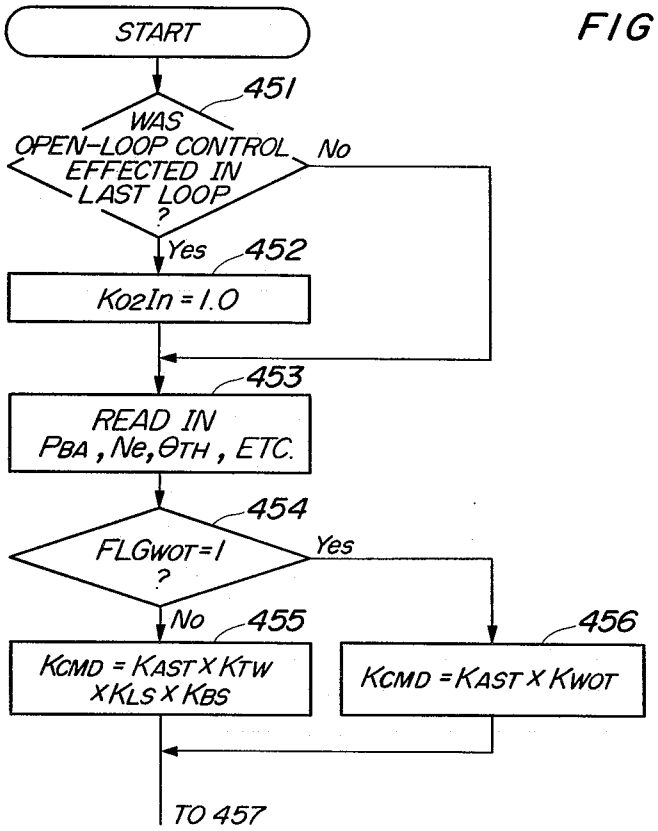
FIGS. 4, 4A and 4B are a flowchart of a subroutine for calculating a desired air-fuel ratio coefficient $K_{CMD}$.
Figure 4B:
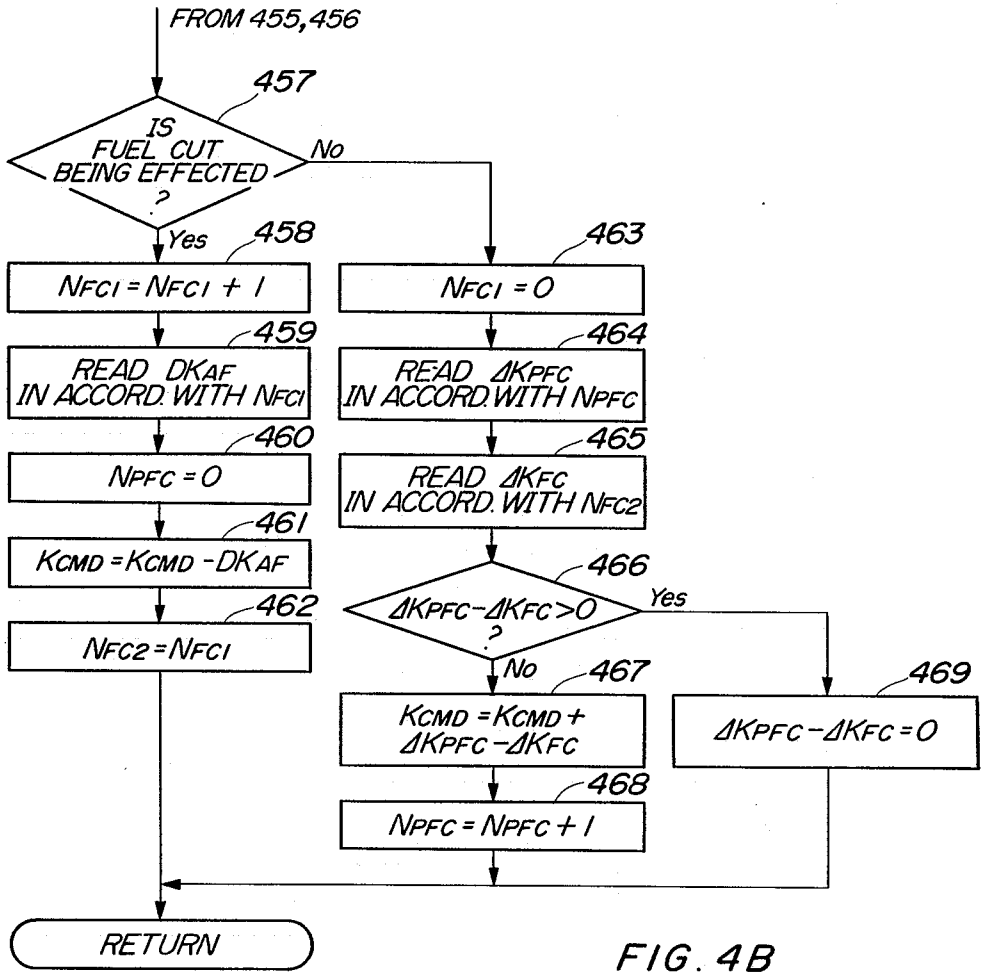

FIG. 4 shows a subroutine for calculating a value of the desired ratio coefficient $K_{CMD}$, which is executed upon generation of each pulse of the TDC signal and in synchronism therewith when the engine 2 is in the feedback control region.

First, at a step 451, it is determined whether or not open-loop control was effected in the immediately preceding loop. If the answer is affirmative or Yes, that is, if the present loop is the first loop after the engine has been brought from an open-loop control region into the feedback control region, an integral control term $K_{02In}$ of the air-fuel ratio correction coefficient $K_{02}$ is set to 1.0 at a step 452. On the other hand, if the answer is negative or No, the program jumps to a step 453.

At the step 453, read in are respective values of engine operating parameters such as the intake pipe absolute pressure $P_{BA}$, the engine rotational speed Ne, and the opening degree $\theta_{TH}$ of the throttle valve. Then, it is determined at a step 454 whether or not a flag $FLG_{WOT}$ has been set to 1. The flag $FLG_{WOT}$ is set to 1 when it is determined that the engine 2 is in a wide-open-throttle region (hereinafter referred to as "the WOT region") included within the feedback control region. This determination is made depending upon the throttle valve opening degree $\theta_{TH}$, the intake pipe absolute pressure $P_{BA}$, and the engine rotational speed Ne, for example.

If the answer to the question of the step 454 is negative or No, that is, if the engine is in a region other than the WOT region, within the feedback control region, a value of the desired ratio coefficient $K_{CMD}$ is calculated at a step 455 by the use of the following equation (2):

$$K_{CMD}=K_{AST}\times K_{TW}\times K_{LS}\times K_{BS} \quad (2)$$

where $K_{BS}$ represents a first basic value of the desired ratio coefficient $K_{CMD}$, which is read from a map, not shown, stored in the ROM 409, in accordance with the engine rotational speed Ne and the intake pipe absolute pressure $P_{BA}$. $K_{AST}$ is an after-start fuel increment coefficient which is set depending upon the engine coolant temperature $T_W$, and the intake air temperature $T_A$, $K_{TW}$ a coolant temperature-dependent coefficient which is set depending upon the engine coolant temperature $T_W$, and $K_{LS}$ a mixture-leaning coefficient which is set to a value smaller than 1.0 when the engine 2 is in a predetermined decelerating state.

If the answer to the question of the step 454 is affirmative or Yes, that is, if the engine 2 is in the WOT region, a provisional value of the desired ratio coefficient $K_{CMD}$ is calculated at a step 456 by the use of the following equation (3):

$$K_{CMD}=K_{AST}\times K_{WOT} \quad (3)$$

where $K_{WOT}$ is a second basic value of the desired ratio coefficient $K_{CMD}$, which is applied in the WOT region, and read from a map stored in the ROM 409, in accordance with the engine rotational speed Ne and the intake pipe absolute pressure $P_{BA}$. The second basic value $K_{WOT}$ is set such that it is larger than the first basic value $K_{BS}$ with respect to the engine rotational speed Ne or the intake pipe absolute pressure $P_{BA}$ so that the desired air-fuel ratio in the WOT region can be set to a richer value than in a region other than the WOT region of the feedback control region.

After executing the step 455 or 456, the program proceeds to a step 457, wherein it is determined whether or not fuel cut is being carried out by the engine 2. If fuel cut is being carried out, a first control variable $N_{FCI}$ is increased by 1 at a step 458. The first control variable $N_{FCI}$ is reset to 0 at a step 463, hereinafter referred to, when the fuel cut is terminated. Consequently, the first control variable $N_{FCI}$ represents the number of TDC signal pulses so far generated after the start of the fuel cut and hence the time period over which the fuel cut has been carried out until the present time.

Then, a decremental value $DK_{AF}$ is read from a table stored in the ROM 409 in accordance with the first control variable $N_{FCl}$ at a step 459. FIG. 5 shows the $DK_{AF}$ table, according to which the decremental value $DK_{AF}$ is set to a larger value as the first control variable $N_{FCl}$ increases. Specifically, the decremental value $DK_{AF}$ is set such that it is equal to 0 when the first control variable $NF_{Cl}$ is equal to 0, and set to first, second, and third values $DK_{AFl}$, $D_{KAF2}$, and $DK_{AF3}$ as the variable $N_{FCl}$ assumes first, second, and third predetermined values $N_{FCll}$, $N_{FC12}$ and $N_{FC13}$, respectively. Further, it is set to and held at a fourth value $D_{KAF4}$ when the variable $N_{FCl}$ assumes a fourth predetermined value $N_{FC14}$ or a larger value. When the first control variable $N_{FCl}$ falls between these predetermined values 0, $N_{FCll}$, $N_{FC12}$, $N_{FC13}$, and $N_{FC14}$, the decremental value $DK_{AF}$ is determined by an interpolation method.

Then, a second control variable $N_{PFC}$ is set to 0 at a step 460. The second control variable $N_{PFC}$ is increased by 1 at a step 468, hereinafter described, whenever a TDC signal pulse is generated while no fuel cut is being carried out. Consequently, the value of the second control variable $N_{PFC}$ represents the number of TDC signal pulses generated so far after the fuel cut was terminated and hence the time period over which fuel has been supplied to the engine 2 until the present time.

Then, a final value of the desired ratio coefficient $K_{CMD}$ is determined at a step 461 by subtracting the decremental value $DK_{AF}$ from the provisional value of the desired ratio coefficient $K_{CMD}$ which has been calculated at the step 455 or 456. Thus, when fuel cut is being carried out, the desired ratio coefficient $K_{CMD}$, which is first calculated in accordance with operating conditions of the engine 2, is decreased by the decremental value $DK_{AF}$ determined in accordance with the first control variable $N_{FCl}$ so that the value of coefficient $K_{CMD}$ is progressively decreased until the lapse of a predetermined time period after commencement of the fuel cut (time periods A and E in FIG. 6), and thereafter maintained at a constant value (time period B in FIG. 6). Then, a third control variable $N_{FC2}$ is set to the first control variable $N_{FCl}$ at a step 462, followed by terminating the program.

Figure 7:
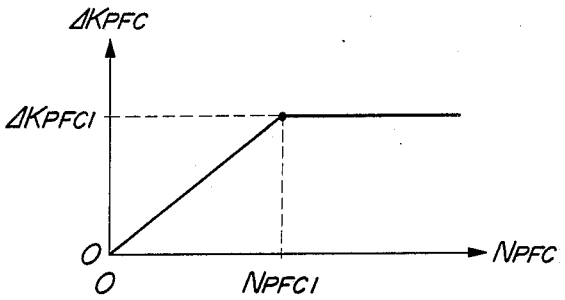
FIG. 7 is a graph showing a table of an additive term $\Delta K_{PEC}$ applied in the subroutine of FIG. 4.

On the other hand, if the answer to the question of the step 457 is negative or No, that is, if no fuel cut is being carried out by the engine 2, the first control variable $N_{FCl}$ is reset to 0 at the step 463, as mentioned before. Then, an additive term $\Delta K_{PFC}$ is read from a table stored in the ROM 409 in accordance with the second control variable $N_{PFC}$ at a step 464. As shown in the table of FIG. 7, the additive term $\Delta K_{PFC}$ is set such that it is equal to 0 when the second control variable NPFC assumes 0, increases proportionally with increase in the value $N_{PFC}$, and equal to a predetermined constant value $\Delta K_{PFCl}$ when the value $N_{PFC}$ assumes a predetermined value $N_{PFCl}$ or a larger value.

Figure 8:
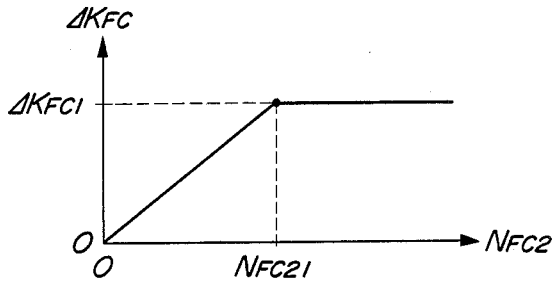
FIG. 8 is a graph showing a table of a subtractive term $\Delta K_{FC}$ applied in the subroutine of FIG. 4.

Then, a subtractive term $K_{FC}$ is read from a table stored in the ROM 409 in accordance with the third control variable $N_{FC2}$ at a step 465. The third control variable $N_{FC2}$, which has been set to the first control variable $N_{FCl}$ at the step 462 during the fuel cut, is maintained at the set value, $N_{FCl}$, when the fuel cut is terminated, without being reset to 0, as distinct from the first control variable $N_{FCl}$. Therefore, the third control variable $N_{FC2}$ represents the number of TDC signal pulses generated during the immediately preceding fuel cut and hence the time period over which the same fuel cut was carried out. FIG. 8 shows a table of the subtractive term $\Delta K_{FC}$, in which the subtractive term $\Delta K_{PF}$ is set, similarly to the additive term $\Delta K_{PFC}$, such that it is equal to 0 when the third control variable $N_{FC2}$ assumes 0, increases proportionally with increase in the value $N_{FC2}$, and equal to a predetermined constant value $\Delta K_{FCl}$ when the value $N_{FC2}$ assumes a predetermined value $N_{FC21}$ or a larger value.

Then, it is determined at a step 466 whether or not the difference between the additive term $\Delta K_{PFC}$ determined at the step 465 and the subtractive term $\Delta K_{FC}$ determined at the step 465 is larger than 0. If the answer is negative or No, that is, if $\Delta K_{PFC}-\Delta K_{FC} \leqq 0$ is satisfied, the difference $\Delta K_{PFC}-\Delta K_{FC}$ is added to the provisional value of the desired ratio coefficient $K_{CMD}$ which has been calculated at the step 455 or 456, to obtain a final value of the desired - ratio coefficient $K_{CMD}$ at a step 467. Then, the second control variable $N_{PFC}$ is increased by 1 at a step 468, as mentioned before, followed by terminating the program.

On the other hand, if the answer to the question of the step 466 is affirmative or Yes, that is, if $\Delta K_{PFC}-\Delta K_{FC}>0$ is satisfied, the difference $\Delta K_{PFC}-K_{FC}$ is reset to 0 at a step 469, followed by terminating the program. Thus, the provisional value of the desired ratio coefficient $K_{CMD}$ determined at the step 455 or 456 is maintained as it is without being increased or decreased.

As described above, immediately after termination of the fuel cut, the subtractive term $\Delta K_{FC}$, which is determined in accordance with the third control variable $N_{FC2}$ corresponding to the time period over which the immediately preceding fuel cut has been effected, surpasses the additive term $\Delta K_{PFC}$, which is determined in accordance with the second control variable $N_{PFC}$ corresponding to the time period elapsed after the termination of the fuel cut, so that the difference between the former and the latter, i.e., $\Delta K_{PFC}-\Delta K_{FCl}$, becomes negative to render the answer to the question of the step 466 negative or No, whereby the step 467 is executed. Therefore, immediately after termination of the fuel cut, the desired ratio coefficient $K_{CMD}$ is first set to a value which is smaller than a value corresponding to engine operating conditions, and then progressively increased with increase in the additive term $\Delta K_{PFC}$ as time elapses (the time periods C and F in FIG. 6).

By thus gradually increasing the desired ratio coefficient $K_{CMD}$ from a value smaller than a value corresponding to the engine operating conditions, the desired air-fuel ratio is progressively decreased from a value larger than a value corresponding to the engine operating conditions after termination of the fuel cut, so that the actual air-fuel ratio is controlled in accordance with the behavior of the actual air-fuel ratio that it is temporarily leaned due to adhering of fuel to the intake pipe inner wall immediately after termination of the fuel cut, and thereafter gradually enriched. Thereafter, the air-fuel ratio is controlled in a feedback manner responsive to the output of the $O_2$ sensor 1 proportional to the concentration of oxygen in the exhaust gases, thereby improving the stability and accuracy of the control and hence the fuel consumption and emission characteristics, etc.

Further, since the progressive decrease of the desired air-fuel ratio is controlled based on the third control variable $N_{FC2}$, which corresponds to the duration of the immediately preceding fuel cut, as well as on the second control variable $N_{PFC}$, which corresponds to the time period elapsed after termination of the fuel cut, the air-fuel ratio can be set depending upon the degree of temporary leaning of the mixture immediately after termination of the fuel cut as well as on engine operating conditions promptly and accurately, to thereby enable smoothly bringing the engine 2 into usual feedback control operation.

On the other hand, as time elapses after termination of the fuel cut, the additive term $\Delta K_{PFC}$ progressively increases to surpass the subtractive term $\Delta K_{FC}$, to thereby render the answer to the question of the step 466 affirmative or Yes. As a consequence, the step 469 is executed to maintain the value of the desired ratio coefficient $K_{CMD}$ corresponding to engine operating conditions, set at the step 455 or 456, thereby bringing the engine 2 into usual feedback control operation (time periods D and G in FIG. 6).

Figure 9:
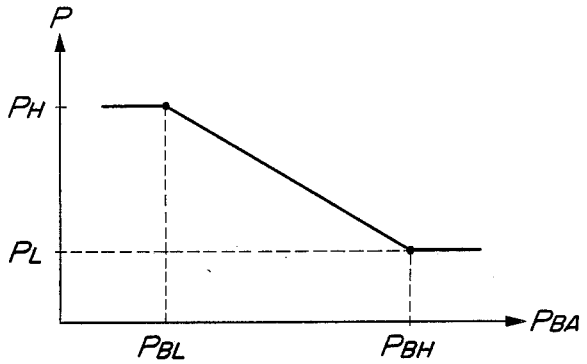
FIG. 9 is a graph showing a table for setting a predetermined number P of TDC signal pulses indicative of delay in the control system.

Incidentally, the actual air-fuel ratio varies with delay with respect to variation in the actual ratio coefficient $K_{ACT}$ due to control lag of the air-fuel ratio control system, as shown by the actual ratio coefficient $K_{ACT}$ in FIG. 6. To compensate for this delay, the air-fuel ratio correction coefficient $K_{02}$ is calculated by the use of a predetermined number P of TDC signal pulses corresponding to the delay, in such a manner that it is calculated based on the difference between a value $K_{CMD(n-p)}$ of the desired ratio coefficient $K_{CMD}$, which was obtained in a loop preceding the present loop by the predetermined number P of loops, and a value of the actual ratio coefficient $K_{ACT}$ obtained in the present loop. FIG. 9 shows a table for setting the predetermined number P, wherein the predetermined number P is set based on the absolute pressure $P_{BA}$ within the intake pipe such that it is set to a first predetermined value $P_H$, e.g., 20, when the value $P_{BA}$ is equal to or lower than a predetermined lower value $P_{BL}$, to a second predetermined value $P_L$, which is smaller than the first predetermined value $P_H$, when the value $P_{BA}$ is equal to or higher than a predetermined higher value $P_{BH}$. When the value of the intake pipe absolute pressure $P_{BA}$ falls between the predetermined values $P_{BL}$ and $P_{BH}$, the number P is determined by an interpolation method. Since as hereinbefore mentioned, the present program is executed upon generation of each TDC signal pulse and in synchronism therewith, the predetermined number P by the control system is thus determined from the engine rotational speed Ne and the intake pipe absolute pressure $P_{BA}$.

What is claimed is:

1. In an air-fuel ratio control method for an internal combustion engine having an exhaust gas-ingredient concentration sensor provided in an exhaust system thereof and generating an output proportional to the concentration of an ingredient contained in exhaust gases emitted from said engine, wherein the air-fuel ratio of a mixture supplied to said engine is controlled to a desired air-fuel ratio corresponding to an operating condition in which said engine is operating, in a feedback manner responsive to the output of said sensor, and supply of fuel to said engine is interrupted while said engine is in a predetermined decelerating condition, the improvement comprising the steps of;

progressively decreasing said desired air-fuel ratio from a value larger than a value corresponding to the operating condition of said engine to the latter value after said engine leaves said predetermined decelerating condition, and controlling the air-fuel ratio of said mixture supplied to said engine to the progressively decreased air-fuel ratio in said feedback manner.

2. A method as claimed in claim 1, wherein said progressive decrease of said desired air-fuel ratio is effected based upon a time period over which said interruption of fuel supply was effected and a time period elapsed after termination of said interruption of fuel supply.

3. A method as claimed in claim 2, comprising the steps of determining a provisional value of said desired air-fuel ratio depending upon operating conditions of said engine after said engine leaves said predetermined decelerating condition, determining a first value based upon said time period over which said interruption of fuel supply to said engine was effected, determining a second value based upon said time period elapsed after termination of said interruption of fuel supply, and correcting the provisional value of said desired air-fuel ratio by the determined first and second values to progressively decrease said desired air-fuel ratio.

4. A method as claimed in claim 2, comprising the steps of determining a provisional value of a coefficient determining said desired air-fuel ratio depending upon operating conditions of said engine after said engine leaves said predetermined decelerating condition, determining a first value based upon said time period over which said interruption of fuel supply to said engine was effected, determining a second value based upon said time period after termination of said interruption of fuel supply, correcting the determined provisional value of said coefficient by the determined first and second values, and correcting a basic fuel supply amount corresponding to operating conditions of said engine by the corrected value of said coefficient to progressively decrease said desired air-fuel ratio.

5. A method as claimed in claim 4, wherein said first value is subtracted from said second value to obtain a difference therebetween, and said determined provisional value of said coefficient is corrected by the difference.

6. A method as claimed in claim 5, wherein said first value is set to larger values as said time period over which said interruption of fuel supply to said engine was effected is longer.

7. A method as claimed in claim 5 or claim 6, wherein said second value is set to larger values as said time period elapsed after termination of said interruption of fuel supply to said engine is longer.

8. A method as claimed in claim 4, including the steps of determining a value of a second coefficient in response to the output of said sensor, and correcting said basic fuel supply amount based upon a difference between the corrected value of said first coefficient determining said desired air-fuel ratio and the determined value of said second coefficient.

9. A method as claimed in claim 8, wherein said basic fuel supply amount is corrected based upon a difference between the corrected value of said first coefficient determined upon generation of a pulse of a crank angle signal generated at a predetermined crank angle of said engine before generation of the present pulse by a predetermined number of pulses and the value of said second coefficient determined upon generation of the present pulse of said second coefficient.

10. A method as claimed in claim 9, wherein said predetermined number of pulses of said crank angle signal is determined depending upon operating conditions of said engine.

11. A method as claimed in claim 10, wherein said predetermined number of pulses of said crank angle signal is determined depending upon absolute pressure within an intake pipe of said engine.

* * * * *